United States Patent [19]

Krauss

[11] 4,158,444

[45] Jun. 19, 1979

[54] METHOD AND APPARATUS FOR CONNECTING A YARN AND FOR FORMING A YARN RESERVE AT A BOBBIN TUBE

[75] Inventor: Otto Krauss, Stuttgart, Fed. Rep. of Germany

[73] Assignee: Luwa AG, Zürich, Switzerland

[21] Appl. No.: 874,904

[22] Filed: Feb. 3, 1978

[30] Foreign Application Priority Data

Feb. 9, 1977 [DE] Fed. Rep. of Germany ..... 2705392

[51] Int. Cl.[2] ..... B65H 54/02; B65H 67/04

[52] U.S. Cl. ..... 242/18 PW; 242/19; 242/35.5 A

[58] Field of Search ..... 242/18 PW, 18 R, 18 DD, 242/18 A, 19, 35.5 A

[56] References Cited

U.S. PATENT DOCUMENTS

| | | | |
|---|---|---|---|
| 3,974,972 | 8/1976 | Egli et al. | 242/18 PW |
| 4,084,759 | 4/1978 | Piro | 242/18 PW |

*Primary Examiner*—Stanley N. Gilreath

*Attorney, Agent, or Firm*—Werner W. Kleeman

[57] ABSTRACT

A method of, and apparatus for, connecting a yarn and for forming a yarn reserve at an empty bobbin tube during a bobbin change following the removal of a full bobbin or package at a spinning location of a spinning machine, especially an open end (OE) - spinning machine, wherein prior to travel of the yarn into a guide channel, there is formed at a yarn infeed element a free yarn path where the yarn is guided only at the start and end of the yarn path and is freely accessible at all sides therebetween. The free yarn path is advanced manually by means of the yarn infeed element towards the new bobbin tube and at that location for the connection of the yarn with the bobbin tube is brought into the engagement region of entrainment means revolving with the bobbin tube and arranged at an edge of such tube. After seizing and entraining the yarn located in the free yarn path by the entrainment means the yarn located in the guide channel of the infeed element is severed and the infeed element is manually removed from the new bobbin tube.

26 Claims, 10 Drawing Figures

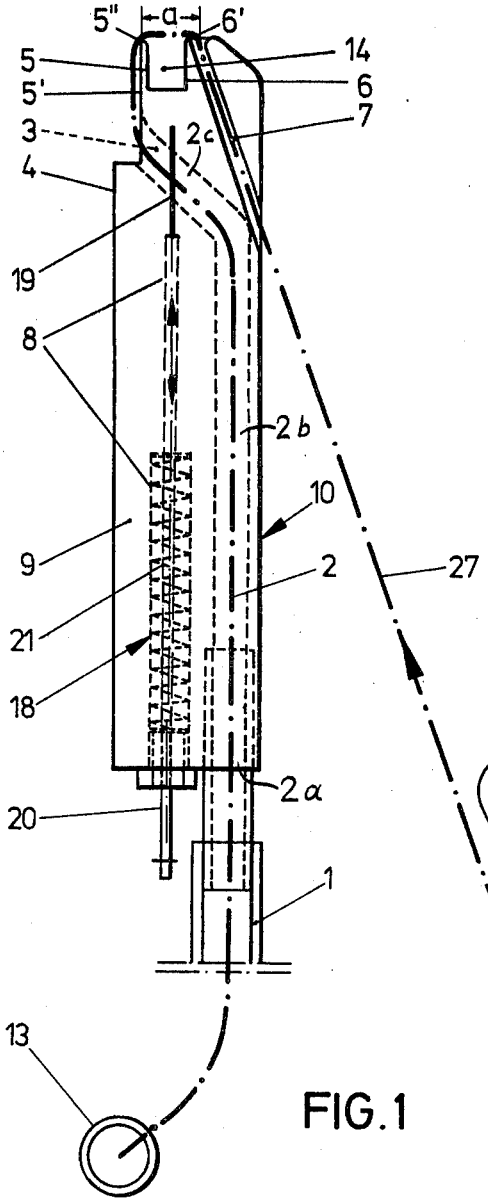
FIG.1
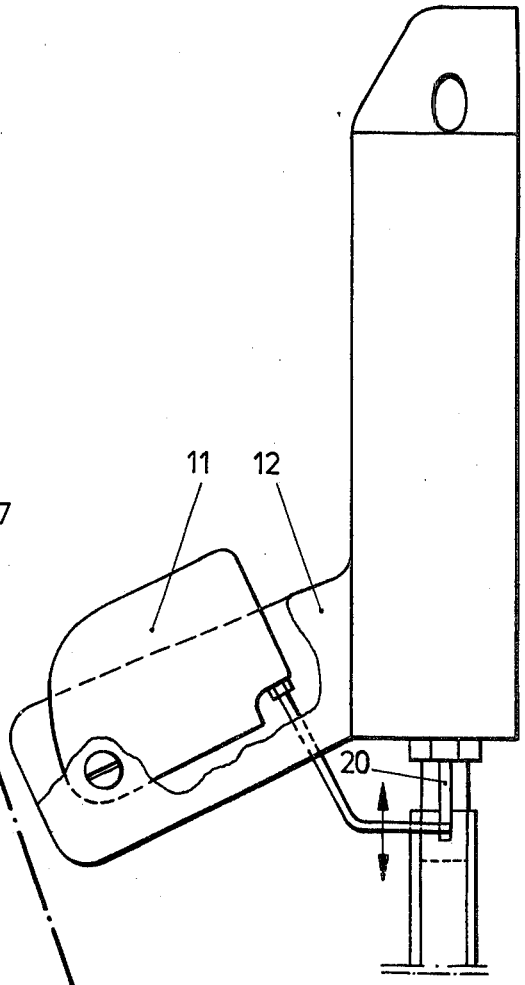
FIG.2
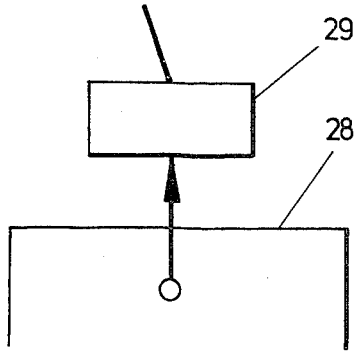

METHOD AND APPARATUS FOR CONNECTING A YARN AND FOR FORMING A YARN RESERVE AT A BOBBIN TUBE

BACKGROUND OF THE INVENTION

The present invention relates to a new and improved method of, and apparatus for, connecting a yarn or other filamentary material—hereinafter simply referred to generically as "yarn"—and for forming a yarn reserve at a bobbin tube or sleeve. This invention also relates to apparatus for the performance of such method.

Generally speaking, there is taught a method for connecting a yarn and for forming a yarn reserve at a bobbin tube or sleeve during the bobbin change after the removal of a full bobbin at a spinning location of a spinning machine, especially at an open end-spinning machine briefly designated as an OE-spinning machine, wherein the yarn, during the bobbin change, is continuously further produced by the spinning location and after removal and servering the full bobbin or package, is sucked by means of a guide channel, through an infeed element which can be manually seized and moved, into a stationary suction opening. Thereafter, the infeed element is manually moved, while entraining the throughpassing yarn, towards the new empty bobbin tube, and brought into a position relative thereto where the yarn arriving at the infeed element is received by a yarn take-up or receiving element provided at the new bobbin tube. Upon severing the part of the yarn located in the yarn infeed element and travelling towards the suction opening, the yarn is wound onto the bobbin tube.

Now in German Pat. No. 26 22 119 there is taught to the art a method and apparatus of the previously mentioned type, wherein the infeed element is constructed as a tubular section, the interior of which forms the guide channel through which travels the yarn. At a bobbin holder, carrying that end of the new bobbin at which there should be connected the yarn and where there is to be formed the yarn reserve, there is provided a guide disc. This guide disc is oriented perpendicular to the bobbin axis and at a slight spacing from the yarn reserve end of the bobbin tube or bobbin and protrudes radially outwardly past the periphery of the bobbin tube. Further, this guide disc has an essentially circular-shaped outer edge extending over part of its circumference. This circular-shaped outer edge merges into a radially inwardly extending guide edge portion at a location thereof where a holder arm of the bobbin holder extends away from the disc. The guide edge portion or part then continues in the form of a further arc-shaped part of smaller diameter over the therewith merging region of the disc. The radial guide edge is also equipped with an inclined surface which essentially extends at an inclination outwardly from the inner surface confronting the tube and from the tube end with regard to the outer surface. At the guide disc there is provided approximately at the side situated diametrically opposite the end of the holder arm of the bobbin holder, a guide plate having a guide section which constricts markedly inwardly from an edge of such plate. Furthermore, a rod or blade-shaped spring is attached to the bobbin holder. The free spring end resiliently bears at the surface of the guide plate confronting the bobbin holder, adjacent a cut-out at its region located closer to the bobbin. The bobbin or package tube is provided at that end where there is to be formed a yarn reserve with a roughened portion extending completely about its periphery and in the form of grooves directed essentially parallel to the generatrices or surface lines.

With this prior art method and the associated equipment the connection of a continuously infeed yarn with a new empty bobbin tube or bobbin is accomplished in such a manner that after mounting the new empty tube at the bobbin holder the tubular-shaped infeed element, which initially is located in front of the stationary suction opening through which there is sucked-up the yarn, is manually seized and moved towards the new bobbin tube. The infeed element forms a guide tube in the direction of the one end of which there travels the yarn delivered by the spinning machine and through the other end of which such yarn travels, after passing through the tube, towards the stationary suction opening. The infeed element is then manually brought into such a position relative to the new bobbin tube that the part of the yarn travelling from the spinning machine to the infeed element, at the region of the cut-out of the guide plate arrives at the guide disc of the bobbin holder and subsequently comes to bear at the inclined surface of the radial guide edge of the guide disc. Now if then the infeed element is manually moved somewhat towards the bobbin holder, then the incoming yarn is introduced into the narrowest base part of the tappering or narrowing guide cut-out of the guide plate. At the same time the yarn arrives between the rod-shaped or blade-shaped spring and the guide plate—which spring bears against the inside of the guide plate—and by virtue of the prevailing clamping action is exposed to increased friction. Consequently, the part of the yarn which extends from the cut-out in the guide plate to the infeed element is exposed to greater tension. Now if the infeed element is still further moved towards the bobbin holder, then the yarn part located between the guide plate and the radial guide edge comes to bear at the roughened end of the tube or sleeve. Viewed in a direction perpendicular to the tube axis, the yarn thus travels at a slight inclination with respect to the tube over the tube edge towards the outside. Thereafter, by means of a cutter or knife arranged at the infeed element and moved into and transversely with regard to the tubular section, the yarn passing through the tubular section or tube is cut or severed. The part of the yarn travelling onto the tubular section and located forwardly of the cutting location, situated between the contact point of the yarn with the bobbin tube and the infeed element, is entrained by the bobbin tube owing to rotation thereof and forms a free yarn end protruding past the edge of the bobbin tube. This free yarn end is wound-up during the further rotation of the bobbin tube amounting to a number of yarn coils or windings which are formed from the yarn which is infed via the cut-out in the guide plate. The entrainment of the yarn by the bobbin tube is accomplished by virtue of the friction prevailing between the roughened outer surface or jacket of the revolving bobbin tube and the yarn bearing thereat.

With this known method it is necessary to provide a specially constructed bobbin holder having a guide plate and guide disc with contact edge, so that this state-of-the-art method cannot be used with already existing equipment, or at the very best only by carrying out considerable and costly structural modifications. Moreover, the successful connection of the yarn with the bobbin tube, according to such prior art method, is essentially dependent upon the care and dexterity of the operator, who must move the tubular-shaped infeed element past the bobbin tube into a position where the incoming yarn properly comes into contact with the bobbin tube. Since such movement must be accomplished without the aid of any guide means, and thus the infeed element must be brought into a certain spatial position without any support and freely manually, there is a relatively great danger that the yarn connection operation will not be satisfactorily accomplished due to improper positioning of the infeed element.

SUMMARY OF THE INVENTION

Hence, with the foregoing in mind it is a primary object of the present invention to provide an improved method of, and apparatus for, connecting a yarn and for forming a yarn reserve at a bobbin tube, in a manner not associated with the aforementioned drawbacks and limitations of the prior art proposals.

Still a further significant object of the present invention aims at providing a new and improved method and apparatus of the previously mentioned type, which beneficially can be employed simply and without any great expenditure even at existing spinning installations, and furthermore, renders possible yarn connection and yarn reserve formation at a new bobbin tube during the bobbin change operation in an extremely simple, rapid and reliable fashion.

Yet a further significant object of the present invention is directed to novel constructions of equipment for connecting a yarn and for forming a yarn reserve at a bobbin tube or the like, which equipment is extremely simple in construction, economical to manufacture, reliable in operation, not readily subject to breakdown or malfunctions, and requires a minimum of servicing and maintenance.

Now in order to implement these and still further objects of the invention, which will become more readily apparent as the description proceeds, the method aspects of the present invention are manifested by the features that there is formed a free yarn path at the infeed element prior to travel of the yarn into the guide channel. At this free yarn path the yarn is only guided at the start and end of such yarn path and at locations intermediate thereof is accessible at all sides. The free yarn path is moved by means of the infeed element manually towards the new bobbin tube and at that location, for connecting the yarn with the bobbin tube, is brought into engagement with an entrainment element at an engaging or seizing region thereof, each such entrainment element revolving with the bobbin tube and being arranged at an edge of such bobbin tube. After the entrainment element seizes and entrains the yarn located at the free yarn path, the yarn located in the guide channel of the infeed element is severed and the infeed element is manually removed from the new bobbin tube.

In relation to the state of the art procedures the novel method of the present invention has appreciable advantages. With this method there is formed a free yarn path which is defined in its dimensions. Further, this free yarn path can be moved manually, in the manner of a loop, to the new bobbin tube and at that location can be brought into engagement with an entrainment element or member mounted or otherwise provided at the bobbin tube. With the inventive method it is therefore not necessary to bring the yarn over a region of its length into an exact position at the jacket or outer surface of the tube and to obtain entrainment of the yarn by friction with the tube surface. Rather, there is afforded the much more reliable possibility that the yarn located at the free yarn path can be brought, in the manner of a catch loop, transversely to the displacement path of an entrainment element revolving with the bobbin tube, and thus, can be positively or form-lockingly engaged with the entrainment element. Such measure requires appreciably less concentration and care in performing the operations than the procedures needed for properly moving the infeed element as required with the prior art method discussed above, and moreover, due to the form-locking engagement above-discussed the method can be carried out much more positively and with greater ease. Considered then in toto the method of the invention is therefore simple, reliable and economical.

Advantageously apparatus for the performance of the method aspects of the invention is constructed such that the yarn infeed element coacting with the bobbin tube is equipped with a manually engageable lengthwise extending base body or body, in the interior of which there is provided the guide channel. The rear mouth of the guide channel, directed towards the stationary suction opening, is located at the end of the base body or body which faces away from the bobbin tube during manipulation of the infeed element and its front mouth oriented towards the bobbin tube or bobbin is located at the region of the front end of the base body. There is provided in front of the front mouth of the guide channel a yarn-free running path disposed at the front end of the body along the path of travel of the incoming yarn.

Viewed in the direction of yarn travel, the front and rear ends of the yarn bear at the yarn-free running path in sliding fashion at the base body or parts connected therewith, whereas between such ends the yarn is accessible at all sides without contacting the base body. In this way there is imparted a simple construction to the infeed element, and furthermore, the yarn-free running path provided thereat is exactly defined as concerns the length of the free running portion of the yarn.

A favorable construction of the apparatus of the invention is also realized if the front and rear ends of the yarn-free running path are constructed as edges arranged at the base body.

Continuing, a particularly simple constructional manifestation of the invention is obtained by forming the aforementioned edges integrally or one-piece with the base body and providing a recess or depression between the edges in the base body. With such construction the yarn can be guided over relatively wide surfaces at the front side of the base body. The free accessibility along the yarn-free running path is obtained by the recess in the base body. With this construction it is not necessary to guide the yarn by means of relatively sharp edges which protrude forwardly past the base body.

A further advantageous construction of the inventive apparatus is manifested by the features that viewed in the direction of travel of the yarn there is mounted in front of the yarn-free running path at the base body an infeed trough or channel for the yarn which is open at one side. With this design it is possible to bring that part of the yarn travelling towards the free running path, out of engagement and into engagement with the infeed channel during the movement of the infeed element accomplished manually, by carrying out an appropriate pivoting or rocking of the infeed element. Hence, there is ensured for a quick and simple introduction of the yarn into the yarn path provided in the infeed element or member. The infeed trough or channel additionally provides for the beneficial alignment of the incoming part of the yarn in front of the yarn-free running path, so that the yarn travel can be readily monitored and there is markedly improved manipulation of the infeed element, especially along the path towards the bobbin tube. A simple construction of the invention contemplates forming the infeed channel as a one-piece or integral member with the base body.

A further advantageous construction of the invention is obtained if the infeed channel has a depth decreasing in the direction of yarn travel. In this way the play of the incoming yarn in the infeed trough, in spaced relationship from the free running path, is large enough in order to ensure for mobility of the infeed element over relatively wide limits without the danger of any disturbance in yarn travel, whereas, on the other hand, the yarn is cleanly introduced into the guide or infeed channel directly in front of the yarn-free running path.

A particularly simple possibility of handling the inventive apparatus can be obtained if there is provided at the front end of the base body, adjacent the yarn-free running path, an impact or contact surface for placement of the infeed element at the periphery of the empty bobbin tube for the transfer of the yarn to the entrainment element or member of the bobbin tube. In this way it is possible to bring the infeed element or member into sliding contact with the bobbin tube, and thus, in an exactly defined radial spacing from the lengthwise axis of such tube. Consequently, there is then automatically ensured that the yarn will be seized and entrained in the yarn-free running path by the entrainment element or elements revolving with the bobbin tube. With this construction it is unnecessary to manually retain the infeed element spatially in a certain position in spaced relationship from the bobbin tube, something always associated with the danger of faulty holding of such infeed element and failure in accomplishing the yarn connection operation.

A further construction which is particularly favorable for yarn travel is realized if, viewed in the direction of yarn travel, there is provided behind the rear end of the yarn-free running path at the side of the front mouth of the guide channel and which side is situated closest to the bobbin holder of the bobbin tube, a guide surface in spaced relationship from such front mouth or opening. This guide surface comes into contact with the bobbin holder and provides a free space for the yarn travel. Such construction enables the infeed element or member to be exactly brought, also in its relative position with respect to the bobbin tube, along the bobbin tube axis into the position required for yarn transfer. This is so since the guide surface of the base body can be simply placed into contact with the bobbin holder retaining the one end of the bobbin tube. By virtue of the fact that the guide surface is disposed in spaced relationship from the front mouth or opening of the guide channel, there is beneficially ensured that the yarn travelling towards the front mouth or opening of the guide channel is not clamped between the base body and the bobbin holder and thus braked during its travel.

A construction of the apparatus rendering possible particularly easy handling thereof, is obtainable by providing in the infeed element a cutter device having a cutter or knife movable at one location of the guide channel essentially transversely with respect thereto and into such guide channel. By means of such cutter arranged at the infeed element the yarn which travels away from the free running path and located in the guide channel can be rapidly cut or severed as soon as the part of the yarn located at the free running path of the infeed element is seized by an entrainment element of the bobbin tube and thus transferred to the bobbin tube.

Advantageously, the apparatus of the invention can also be constructed such that the rear mouth or opening of the guide channel of the infeed element is connected by means of a flexible conduit or pipe section with the suction opening. With this design the infeed element constitutes the mouth of the suction opening which is extended by means of the tubular conduit or pipe section and the yarn travelling through the infeed element is screened with regard to the outside along its path of travel from the infeed element to the stationary suction opening at the spinning installation. Hence, so-called "flying threads or yarns" are avoided for certain.

A favorable construction is also realized if there is mounted a handle for manipulation purposes at the base body of the infeed element.

Another advantageous design contemplates coupling the cutter or knife of the cutting device with an actuation device arranged at the infeed element. This actuation device can be activated upon seizure of the infeed element by the hand of the operator.

An especially favorable constructional embodiment of the inventive apparatus contemplates equipping the base body at its front end, as the yarn-free running path, with a trough-shaped recess or depression which starts from the top of the base body confronting the bobbin tube in the position of use of the infeed element. This recess is bounded at the side neighboring the closest situated bobbin holder in the position of use by a side wall. The outer side of such side wall which faces away from the recess extends essentially perpendicular to the end of the base body. The front mouth of the guide channel opens into such outer side at a spacing behind the end. The guide surface merges at the outer side behind the front mouth or opening and is disposed in spaced relationship therefrom and closer to the bobbin holder and extends essentially perpendicular to such end. The infeed trough extends from the top of the base body away from the front end at an inclination towards the rear in the direction of the side of the base body facing away from the guide surface. Below the front mouth of the infeed trough or channel and at the lower end of the trough-shaped recess the contact surface is constructed at the end of the base body as a surface which gradually extends towards the rear and towards the under side of the base body. With this design there is afforded an extremely compact and easy to handle infeed element.

A further beneficial construction of the invention can be obtained if the length of the yarn-free running path is about twice as long as the axial spacing of the yarn reserve from the edge of the tube end and which yarn reserve is to be wound onto one end of the bobbin tube at the start of the wind-up operation. With this arrangement the yarn-free running path is long enough in order to be able to mount at the bobbin tube entrainment elements having dimensions ensuring for adequate strength.

The equipment of the invention also can be advantageously constructed such that the spacing of the guide surface, in the position of use of the infeed element, measured from the start of the yarn-free running path parallel to the lengthwise axis of the bobbin tube, is dimensioned such that the end of the yarn-free running path is disposed approximately in an ideal plane with the tube end. In this way there is rendered possible exact positioning of the infeed element at the bobbin tube by simply contacting the guide surface with the bobbin support or holder.

It is also advantageous if the apparatus of the invention is designed such that the guide channel extends initially at an inclination rearwardly from the front mouth towards the outside and then merges into a channel leading to the rear end of the base body. By virtue of the front portion of the guide channel extending at an inclination with regard to the lengthwise axis of the base body it is possible to arrange elements for cutting the yarn in the guide channel in the base body such that they can be moved in the lengthwise direction of the base body, and thus, can be guided transversely through the guide channel. Due to this construction there is afforded an arrangement of a cutting device in the infeed element which is particularly easy to handle and extremely modest in its space requirements.

An especially favorable design contemplates guiding the cutter of the cutting device in the base body at the region of the inclined part of the guide channel so as to be movable to-and-fro parallel to the primary lengthwise direction of the base body and the contact surface.

Easy handling of the infeed element is ensured if the same is constructed to have a pistol-like grip or handle protruding at an inclination therefrom and mounted at the base body.

A design which is particularly attractive for the practical handling of the apparatus can be realized by mounting an actuation element of the actuation device for the cutter in a position at the infeed element which is accessible by the hand gripping the handle or hand grip.

The apparatus for accomplishing the method aspects of the invention advantageously is designed such that at the edge of the end of the bobbin tube, at which there is to be wound-up a yarn reserve at the start of the winding of the yarn, there are provided cut-outs or notches extending circumferentially about the periphery of the tube and serving as entrainment elements. These cut-outs extend at an inclination inwardly from the circumference or periphery of the edge of the tube in a direction opposite to the rotational sense of the bobbin tube. In this way after the displacement and application of the infeed element at the periphery of the empty bobbin tube, the yarn is engaged and entrained at the region of the yarn-free running path by a cut-out which revolves with the bobbin tube, as soon as the yarn has been brought into the region of movement of the cut-outs at the edge of the bobbin tube.

A favorable construction of the inventive apparatus also considered to comprise an important independently protectable feature of the invention, resides in the features that the bobbin tube or sleeve onto which there is wound the yarn constitutes a tube composed of a hollow cylinder serving as the tube shell or jacket and two circular disc-like tube supports. These tube supports are mounted at respective ends of the hollow cylinder, for instance inserted therein, and are rotatably mounted at a respective bobbin holder. Each tube support has an outer diameter corresponding at least to the outer diameter of the tube and each such tube support, when mounted, covers the neighboring end edge of the hollow cylinder. The cut-outs serving as the entrainment elements are provided at the outer edge of at least one of the tube supports. With this design it is possible to employ standard bobbin tubes or sleeves, and at least one of the tube supports of one such tube can be subsequently modified by providing cut-outs at the circumference thereof which function as entrainment elements. In this way it is possible to structurally modify an existing installation with simple and economical means so as to provide apparatus suitable for accomplishing the method of the invention. A tube having such type constructed tube support equipped with cut-outs serving as entrainment elements can also be employed independently of the inventive infeed element in conjunction with already known devices for connecting a yarn with the tube, whenever such prior art devices are suitable for infeeding a yarn to the cut-outs or notches of the tube support in a manner such that the yarn can be seized and entrained by one of such cut-outs.

A particularly advantageous design is also capable of realization if the cut-outs extend inwardly at an angle $\alpha$ amounting to between 30° and 45°, measured with respect to the ideal radius extending through the starting portion of a cut-out at the outer edge. With such inclined positioning of the cut-outs there is ensured for reliable entrainment of the yarn located at the free running path of the infeed element.

An especially simple design of the equipment of the invention is possible when the cut-outs extend linearly along chord sections of the circular-shaped tube body.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a top plan view, partially schematic, of a first exemplary embodiment of apparatus for the performance of the inventive method;

FIG. 2 is a side view of an infeed element for the apparatus structure of FIG. 1;

DETAILED DESCRIPTION OF THE PREFERRED EMBODIMENTS

Figure 3:
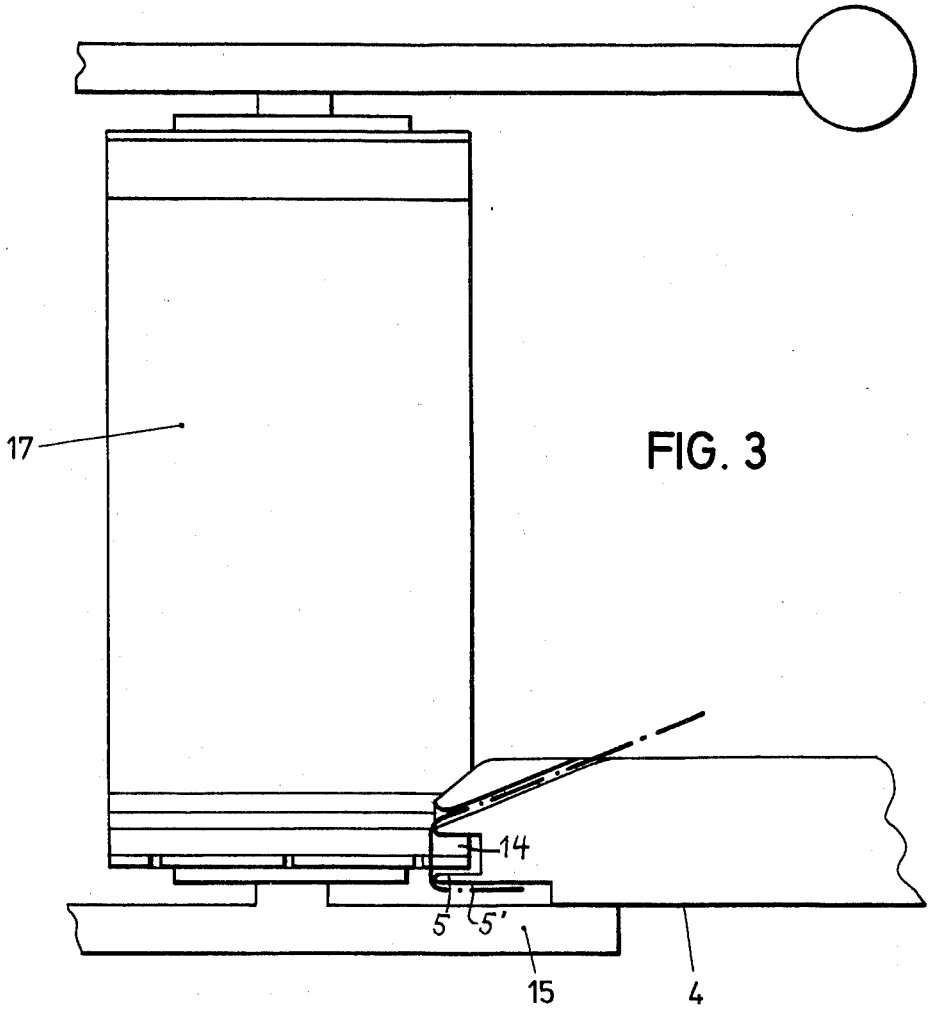
FIG. 3 is a top plan view of the apparatus shown in FIGS. 1 and 2 during the method step of applying the infeed element at the bobbin tube prior to connection of the yarn with such tube.

Considering now the invention in detail, in the case of open end-spinning machines—hereinafter simply referred to as OE-spinning machines—extremely high speeds are attained depending upon the set production speed. With such high yarn speeds there occur problems during the exchange of a complete or full bobbin, upon which there has been wound the infed yarn, for a new empty bobbin or bobbin tube. Whether or not the infed yarn, during the bobbin change operation, can be manually severed or must be cut by a cutting device, depends upon the yarn travel speed and upon the raw material (e.g. cotton, wool or synthetic fibers) processed at the spinning machine and the set twist, for instance α-metric. The inventive method is a so-called "third hand" method, meaning that a respective suction opening is provided at each related spinning location of the spinning installation, into which opening there is sucked the continuously delivered yarn infed by the spinning machine following its severing from the full bobbin and prior to connection with the new empty bobbin tube. The suction nozzles can be designed to be closable and can be connected to the suction system of the OE-spinning machine.

If there should be accomplished a bobbin change at a spinning location, then initially the "third hand" suction nozzle, associated with such spinning location is opened. The full bobbin or package is lifted-off of the drive roll, which extends essentially parallel to such bobbin, by means of a bobbin holder grip mounted at a bobbin tube or bobbin holder. The winding-up of the yarn which is further delivered from the spinning location is thus interrupted. The further delivered yarn is infed, for instance manually, to the "third hand" suction nozzle, seized by such suction nozzle and sucked-up therein. The yarn which dangles from the stationary full bobbin is held, for instance manually, whereas the yarn which is further delivered from the spinning location is sucked-up into the suction nozzle. The yarn can be severed from the full bobbin or bobbin tube by means of a cutting device or by tearing it by hand and the full bobbin can be removed from the bobbin holder together with the free yarn end. Thereafter, there can be mounted a new empty bobbin tube in the bobbin holder and lowered thereon until it comes to lie in contact with the revolving drive roll along a surface line or generatrix thereof and is rotatably driven thereby.

Now in order to be able to connect the yarn continuously delivered by the spinning location of the OE-spinning machine with the new empty bobbin tube, this yarn must be moved in a direction towards the bobbin tube by means of the "third hand" suction nozzle into which it is continuously sucked, and then must be connected in suitable fashion with the bobbin tube so that it can be entrained by such tube during its rotation and would thereon. The introduction and connection of the yarn is accomplished, according to the method of the invention, by means of an infeed element or member having a yarn guide channel which extends through such infeed element and which can be introduced into the path of travel of the yarn in front of the stationary suction nozzle. During the bobbin change the yarn which no longer is to be wound up upon the full bobbin, but still continuously further infed by the spinning location, is not, in this case, directly delivered to the stationary suction opening for sucking-up of the yarn thereby, rather is fed to a front opening of the guide channel of the infeed element. The rear end of the guide channel is in suction communication with the stationary suction opening. The yarn is then sucked through the guide element into the suction opening. In this manner the infeed element can be incorporated along the yarn path of travel between the spinning location and the stationary suction opening. The transport of the yarn to the new empty bobbin tube is accomplished with the method of the invention in that the infeed element is seized by the hand of the operator and moved to the bobbin tube. The manner in which, according to the inventive method, the yarn is connected with the bobbin tube and forms a yarn reserve upon such tube, will be considered and described in detail hereinafter in conjunction with the disclosure regarding the infeed element for accomplishing the method aspects and the entrainment members or elements arranged at a bobbin tube for coacting with the infeed element for the purpose of likewise performing the method of the invention.

Turning attention now to FIG. 1, the infeed element shown in top plan view therein, has been generally designated in its entirety by reference character 10. This infeed element 10 will be seen to comprise a lengthwise extending base body or body member 9. Body member 9 has an essentially quadratic or square configuration. At its rear lower region there is attached a hand grip or handle 12 in the manner of a pistol handle or hand grip. Consequently, the infeed element 10 can be easily seized by the hand of the operator and guided. Provided in the base body 9 of the infeed element 10 is a guide channel 2. The rear mouth or opening 2a of such guide channel 2 is operatively connected by means of a hose or conduit line 1 with the schematically indicated stationary suction opening 13 (FIG. 1) operatively associated with a spinning location of an OE-spinning machine. The base body 9 possesses at its front end or face a substantially trough-shaped recess or depression 14. This recess 14 is bounded by a side wall 5 at the side thereof neighboring the closest situated bobbin or bobbin tube holder 15 (FIG. 3) in the operating position of the infeed element 10. The outer side 5' of the side wall 5 which faces away from the recess 14 extends essentially perpendicular to the end of the base body 9. The front mouth or opening 3 of the guide channel 2 opens into such outer side 5'. The recess 14 at the front side of the base body 9 is bounded at the one side by the wall 5 and at the other by a wall 6. The edges 5'' and 6' formed by these walls 5 and 6 together with the front end of the base body 9 form the ends of a yarn-free running path a determined by the width of the recess 14.

Now at the region of this yarn-free running path a the yarn 27 is accessible at all sides. At the side of the recess 14 facing away from wall 5, and thus viewed in the direction of travel of the yarn 27, there is formed in front of the yarn-free running path a in the base body 9 an infeed trough or channel 7 for the yarn which is open towards the top of such base body 9. This infeed trough or channel 7 extends from the top front end of the base body 9 at an inclination away therefrom towards the rear in the direction of a side surface of the base body 9. The depth of the infeed channel 7, viewed in the direction of travel of the yarn 27, decreases from the start thereof at the side surface of the base body 9 up to the region of the yarn-free running path a. The front end of the infeed channel or trough 7 neighbors the edge 6' at one side of the recess 14. The edges 6' and 5'' thus form deflection edges for a yarn which arrives by means of the infeed channel 7 and at the same time they form, viewed with regard to the direction of yarn travel, the front and rear ends of the yarn-free running path a.

At the end of the base body 9, viewed from the top of such base body, there is provided below the yarn-free running path a a contact surface 16 for the contact of the infeed element 10 at the periphery of the new empty bobbin tube 17. The contact surface 16 is constructed in the form of a surface which gradually extends in the form of an arc from the end of the base body 9 towards the rear in the direction of the under side thereof.

Viewed in the direction of yarn travel there merges a guide surface 4 with the outer side 5' of the base body 9, behind the front mouth or opening 3 of the guide channel in spaced relationship from such mouth 3. This guide surface 4 forms a side surface of the base body 9 and protrudes forwardly or outwardly of the outer side 5' of the wall 5. In this way there is formed between the deflecting edge 5" and the front mouth or opening 3 of the guide channel a free space in which there can travel without obstruction the yarn arriving from the yarn-free running path a. The guide surface 4 serves to apply the infeed element 10 at a bobbin holder 15 (FIG. 3) which supports the bobbin tube 17.

The length of the yarn-free running path a is approximately twice as long as the provided axial spacing of the yarn reserve from the edge of the tube end (cf. FIGS. 3 and 4) and which yarn reserve is to be wound-up onto the empty tube at the beginning of the wind-up operation at one end of such tube. Furthermore, the spacing of the guide surface 4 from the start of the yarn-free running path a, in the position of use of the infeed element, measuring parallel to the lengthwise axis of the bobbin tube, is dimensioned such that the end of the yarn-free running path a is located somewhat externally of the tube end.

The guide channel 2 in the base body 9 of the infeed element 10 extends initially at an inclination towards the rear from the front mouth or opening 3 at the outer side 5' and then merges into a channel **2*b* leading to the rear end of the base body 9. Arranged parallel to the rear part of the guide channel 2 within the base body 9 is a cutting or cutter device, generally designated by reference character 18. This cutting device 18 comprises a cutter or knife 19 guided for to-and-fro movement at the region of the inclined part 2*c* of the guide channel 2 in a guide not shown in detail to preserve clarity in illustration and located within the base body 9. This to-and-fro movement is essentially parallel to the primary lengthwise direction of the base body 9 and the guide surface 4. The cutter or knife 19 can be brought into an advanced position where it extends through the entire cross-section of the guide channel 2 and closes such guide channel. Equally, cutter 19 can be brought into a retracted position where it frees the guide channel. The cutter 19 is operatively coupled by means of a rod 20 and a lever mechanism having a trigger lever 11, which, in turn, can be pivotably mounted at the pistol grip or handle 12 of the infeed element 10 and can be operated by the gripping hand of the operator. In the rest position the cutter or knife 19 is in its advanced position or location due to the action of a compression spring 21 provided within the base body 9 and engaging with the rod 20. In this advanced position, and as mentioned, the cutter 19 closes the guide channel 2. By pressing the trigger or actuation lever 11 against the pistol handle or hand grip 12 the rod 20 and thus the cutter or knife 19 can be moved rearwardly, as a result of which the cutter 19 is moved out of the guide channel 2. Consequently, the guide channel 2 is freed for the suction air current which is effective in the hose line or conduit 1**.

During connection of yarn with the bobbin tube and the formation of a yarn reserve thereon the actuation lever 11 is continuously depressed, in order to thereby ensure sucking-up of yarn by means of the guide channel 2, and specifically for such length of time until the yarn has been connected with the bobbin tube and there has been started the formation of the yarn reserve upon the bobbin tube. The connection of the yarn at the bobbin tube will be explained in greater detail hereinafter. After the connection of the yarn and the formation of the yarn reserve, the actuation lever 11 is then again released by the gripping hand of the user, so that the cutter 19 is shifted forwardly by the action of the compression spring 21 back into its rest position, and thus, severs the yarn travelling in the guide channel 2 and closing such guide channel, so that there is interrupted the suction air current.

At both ends of the bobbin tube 17, at which there is to be wound-up the yarn, there is provided a respective disc-shaped bobbin tube support 22. These bobbin tube supports 22 are designed as discs fabricated from plastic, which are inserted from the ends of the tube 17 into the same. A ball-bearing 23 is mounted at the center of each of the bobbin tube supports 22. Rotatably mounted at the center of such ball-bearings 23 or equivalent structure is a shaft 24. By means of the shaft 24 the bobbin tube supports 22 are mounted at the bobbin holders 15 and rotatable upon the shaft 24. Such construction of the tubes is standard. In order to perform the inventive method it is however necessary to structure at least one of the bobbin tube supports 22 according to the invention such that cut-outs or notches 25 serving as entrainment elements are provided circumferentially about its peripheral edge. These cut-outs 25 extend at an inclination inwardly from the periphery of the edge of the tube support in a direction opposite to the direction of rotation of the bobbin tube 17. The cut-outs 25 are inwardly directed from the outer edge of the tube support at an angle $\alpha$, measured with respect to the ideal radius extending through the starting portion of a cut-out at the outer periphery. In the exemplary embodiment illustrated in FIGS. 4, 6 and 7 this angle $\alpha$ amounts to 45°. In the embodiment under discussion the cut-outs 25 extend linearly along chords sections of each circular disc-shaped tube support 22. The outer periphery of each tube support 22 has the same outer diameter as the tube 17. The cut-outs 25 are thus only accessible from the corners of such tube 17. Now in order to drive the tube 17 such bears in conventional fashion along a generatrix or surface line of its outer periphery at a driven drive cylinder or roll 26. This drive cylinder or roll 26 is arranged essentially parallel to the thereby driven bobbin tube 17, as best seen by referring to FIG. 6. The connection of the yarn 27 with the new empty bobbin tube and the formation of a yarn reserve at the same is accomplished, with the previously described equipment for the performance of the inventive method, in the following manner:

Initially, the full bobbin tube or package is removed and replaced by an empty bobbin tube in the manner which has been previously described in conjunction with the drawings. Now in order to enable the yarn further delivered by the spinning location to travel through the infeed channel 2 of the infeed element 10 towards the suction opening 13, and in order to operatively incorporate the infeed element 10 in the path of travel of the yarn, the actuation lever 11 mounted at the pistol hand grip 12 of the infeed element 10 is manually depressed, so that, as already previously explained, the cutter 19 is retracted and the guide channel 2 in the infeed element 10 is freed. The yarn 27, after it has been manually brought to the front mouth or opening 3 of the guide channel 2 of the infeed element 10, is then acted upon by the suction air current and sucked through the guide channel 2 into the suction opening 13 of the spinning installation. The yarn 27 then travels, as it comes from the spinning location 28, over a yarn withdrawal roll 29 and from that location through the front mouth or opening 3 into the guide channel 2 of the infeed element 10. Then, the yarn travels through the flexible hose or conduit 1 into the stationary suction opening 13 of the spinning installation. It is to be observed that the yarn 27 need not necessarily travel right from the start through the infeed element 10 in the position shown in FIG. 1, and for instance, it would be possible for such yarn initially not to travel through the infeed channel 7 and via the yarn-free running path a to the front mouth or opening 3 of the guide channel 2, rather to travel in a free path directly into the front mouth 3 of the guide channel 2. The base body 9 of the infeed element 10 can be located for instance still in a position directed essentially towards the yarn withdrawal roll. The yarn which is continuously sucked-up from the spinning installation thereafter, by performing mannual manipulations, especially quarter turns of the infeed element 10 about its lengthwise axis, is applied to the edges 5'' and 6' and thus, also reaches the guide trough or channel 7. The infeed element 10 is then located in the position shown in FIG. 1. After these manipulations the yarn 27 travels from the spinning location 28 to the yarn withdrawal roll 29 and from that location within the guide trough or channel 7 to the edge 6'. From the latter the yarn travels to the edge 5'' and from that location into the front mouth or opening 3 of the guide channel 2. Between the edges 6' and 5'' there is formed the yarn-free running path a. The yarn 27 running into the guide channel 2 is delivered from that location to the suction system by means of the flexible conduit or line 1.

Figure 4:
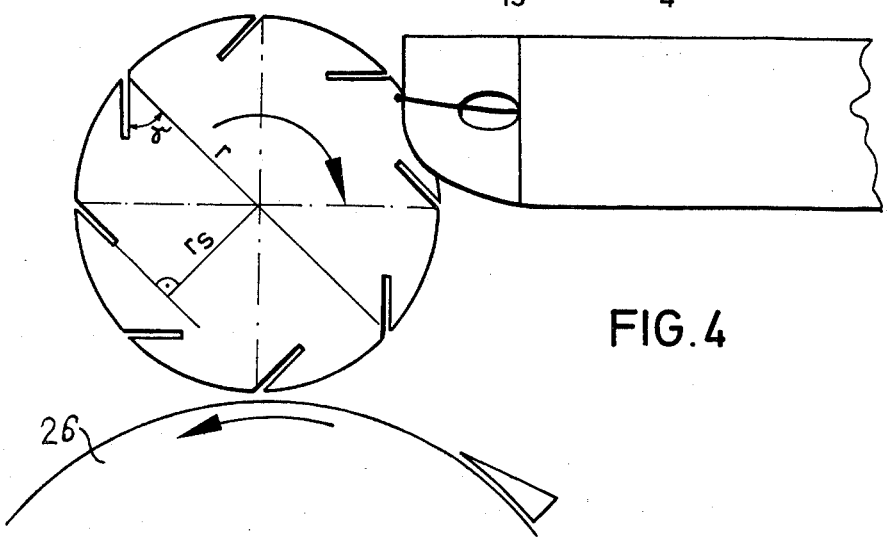
FIG. 4 is a side view of the apparatus in the position of its parts corresponding to the method step illustrated in FIG. 3.
Figure 5:
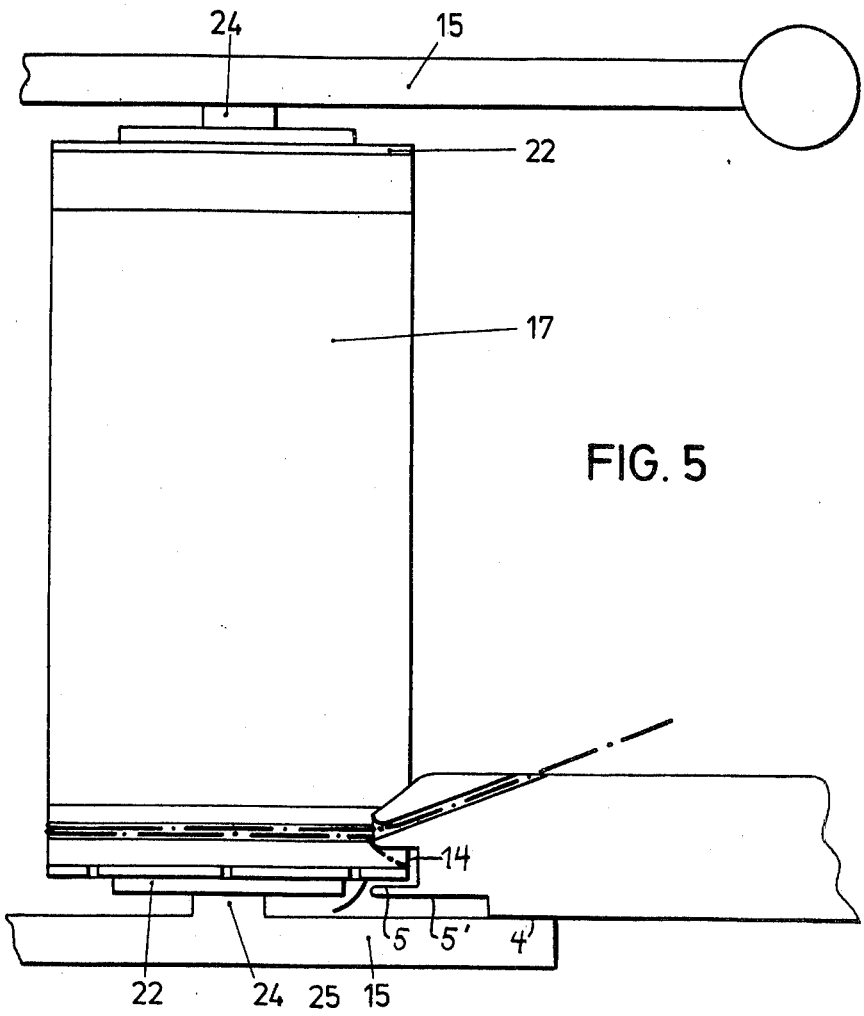
FIG. 5 is a top plan view of the apparatus during the method step or operation where the yarn has already been connected with the bobbin tube and there has been formed a yarn reserve.
Figure 6:
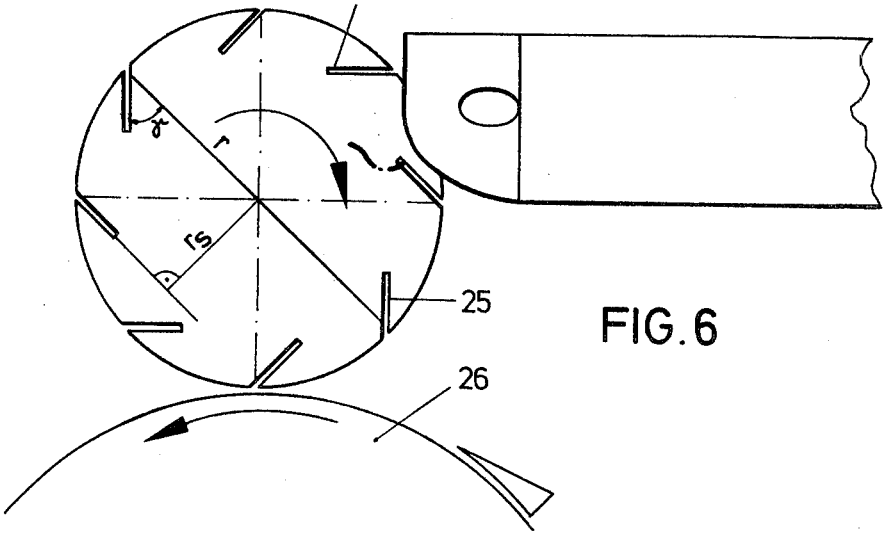
FIG. 6 is a side view of the apparatus showing the parts in the position assumed when performing the method step of FIG. 5.
Figure 7:
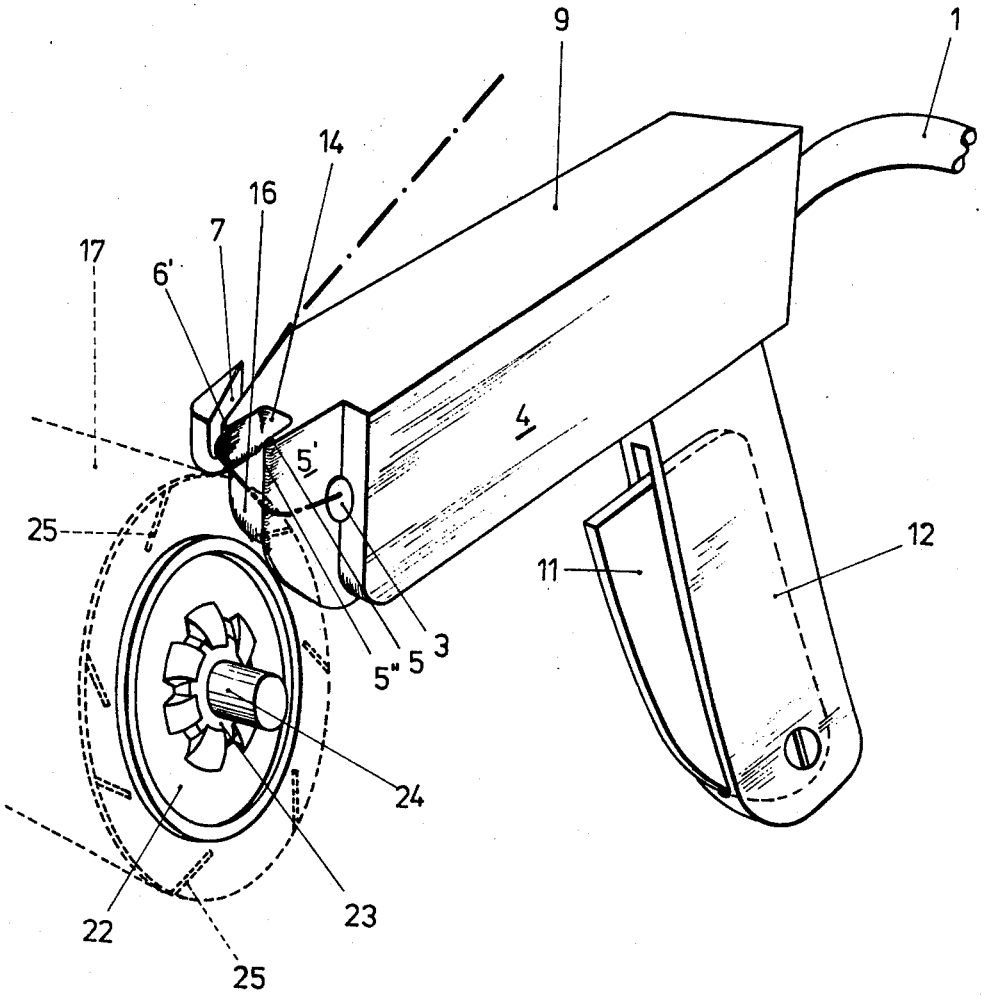
FIG. 7 is a perspective view of the apparatus, partially schematically, shown in FIGS. 1 to 6.

The infeed element 10 now is laterally applied by means of its guide surface 4 at the bobbin or bobbin tube holder 15 and guided forwardly against the revolving bobbin tube 17, until the front contact surface 16 comes into sliding contact with the periphery of the bobbin tube 17. As a result, the infeed element 10 is located above the tube axis (cf. FIGS. 6 and 7). As soon as the infeed element 10 has reached this position the yarn-free running path a of the yarn 27 is disposed at the region of movement of the entrainment cut-outs or notches 25 at the one tube support 22 (cf. FIGS. 3, 4 and 7). During rotation of the bobbin tube 17 the yarn 27 located at the yarn-free running path a, as soon as it has been brought into the path of movement of the cut-outs 25 of the tube support 22, is seized during the progressive revolution of the tube 17 by the mouth of the next cut-out 25 which moves towards the yarn 27 and is drawn into such cut-out 25 (FIGS. 3 and 4). During the further rotation the yarn 27 is entrained by the cut-out 25 and wound about the periphery of the related bobbin tube. The winding-up of a yarn reserve upon the bobbin tube 17 has thus begun (FIGS. 5 and 6). The edge of the bobbin tube 17 is located somewhat at the center of the yarn-free running path a. The spacing of the yarn reserve to be formed from the edge of the bobbin tube is determined, as best seen by referring to FIG. 5, by the edge 6' and the length of the yarn-free running path a as well as the position of the infeed element 10 relative to the bobbin tube 17.

As soon as the yarn 27 has been entrained by one of the cut-outs 25 at the bobbin tube support 22 and there has been started the winding-up of a yarn reserve, the actuation lever 11 of the infeed element 10 is released by the gripping hand of the operator. Consequently, the cutter or knife 19 of the cutting device 18 is pushed forwardly into the guide channel 2 by the action of the compression or pressure spring 21. Hence, the yarn 27 located in the guide channel 2 is severed and at the same time there is interrupted the flow of the suction air current. The yarn 27 then travels through the infeed trough or channel 7 to the periphery of the bobbin tube 17 and at that location is wound-up. After there have been wound-up upon the bobbin tube 17 a number of adjacently situated yarn coils or windings and there has thus been formed an adequate yarn reserve, the infeed element 10 can be manually moved away from the bobbin tube 17 in the direction of the yarn infeed and out of the yarn infeed region. The flexible line or conduit 1 is then removed from the suction nozzle 13. The suction nozzle 13 is then closed.

The further infed yarn 27 finally arrives at the yarn traversing region of a conventional and therefore not particularly illustrated yarn guide provided in front of the bobbin tube 17, is engaged thereby and moved back-and-forth along the length of the bobbin tube 17. In this way there is initiated the formation of a cross-wound package upon the bobbin tube. Hence, there is terminated the connection of the yarn with the bobbin tube 17 and the formation of the yarn reserve and there can now be accomplished the actual winding-up of the yarn onto the bobbin tube 17.

Figure 8:
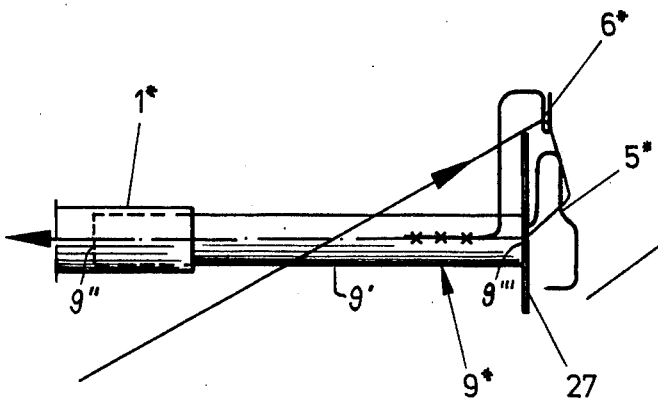
FIG. 8 is a side view of an infeed element of a second exemplary embodiment of apparatus for performing the inventive method and partially shown schematically.
Figure 9:
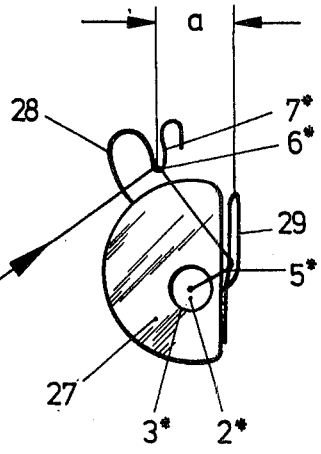
FIG. 9 is a front view of the infeed element depicted in FIG. 8.
Figure 10:
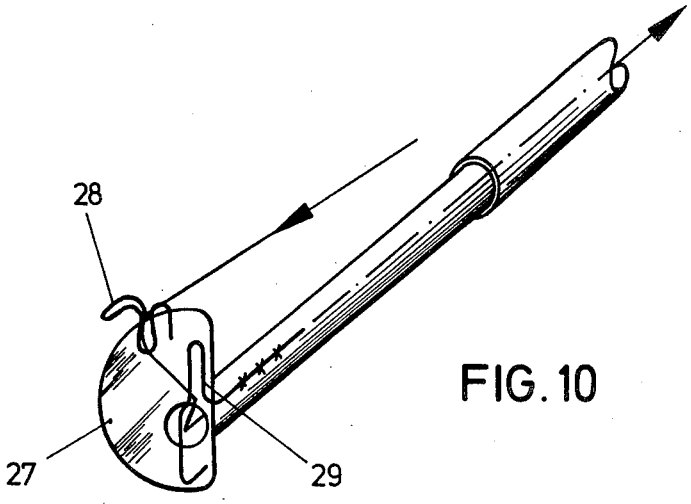
FIG. 10 is a perspective, partially schematic view of the infeed element according to FIGS. 8 and 9.

Continuing, FIGS. 8 to 10 illustrate a second exemplary embodiment of an infeed element of equipment for performing the inventive method. With this exemplary embodiment the infeed element comprises a base body 9* constructed as a tubular section or piece 9'. The interior of such tubular section 9' forms a guide channel 2*. The rear open end 9'' of the tubular or pipe section 9' possesses a rear mouth or opening which is operatively connected by means of a flexible hose conduit or line 1* with a stationary suction opening not particularly illustrated in FIGS. 8 to 10 to preserve clarity and simplicity in the showing of the drawings, but may be similar to what has been discussed previously with the first considered arrangement. The front open end 9''' of the tubular or pipe section 9' forms a front mouth or opening 3* of the guide channel 2*. At the forward or front end of the base body 9* there is provided a plate 27 extending perpendicular to the lengthwise axis of the pipe section 9'. This plate 27 surrounds the front mouth or opening 3* in a flange-like manner. Furthermore, at the region of the front mouth or opening 3* there are attached at the base body 9* two guide parts 28 and 29 formed of metal wire. These guide parts 28 and 29 are arranged and formed such that the guide part 28 provides an infeed trough or channel 7* for the yarn and the guide part 29 likewise has a portion extending in an arc and serving as a yarn guide trough. The infeed trough or channel region 7* of the guide part 28 and the guide trough part in the guide part or section 29, viewed in the direction of the lengthwise axis of the base body 9*, are located in spaced relationship in front of the plate 27. A yarn travelling through the guide trough 7* and through the trough in the guide part 29 thus, at this region, travels in spaced relationship in front of the plate 27 and thus is accessible at all sides. The guide parts 28 and 29 hence form therebetween a yarn-free running path a. The front and rear ends of the yarn-free running path, viewed in the direction of yarn travel are defined by the deflection edges 6* and 5*, respectively, serving as regions of most pronounced curvature, for introducing the yarn into the guide trough 7* and into the trough of the guide part or portion 29, respectively. Also, with the embodiment of infeed element the yarn, incoming from the spinning location, travels through the yarn-free running path a formed by the guide parts 28 and 29 and from that location into the mouth or opening 3* of the guide channel 2* provided in the base body 9* and via the conduit or line 1* to the not particularly illustrated suction nozzle. With this exemplary embodiment of infeed element the connection of the yarn with a new empty bobbin tube is accomplished in principle in the same manner as previously discussed in conjunction with the first described exemplary embodiment. With the embodiment of FIGS. 8 to 10 there is not provided any pistol hand grip at the base body 9*. The handling and manipulation of such infeed element is accomplished by gripping the base body 9* by the hand of the operator or user. The infeed element is then manually moved towards the bobbin tube to the location where there should be accomplished the yarn connection. The plate 27 at the front end of the base body 9* can serve as a contact aid for realizing a suitable connection position, in that such plate or plate member 27 can be brought into sliding contact with the outer surface of the bobbin tube. With this embodiment of infeed element there is not provided any cutting device for the yarn for servering the same after the connection thereof with the bobbin tube. Severing of the yarn, with this embodiment, can be accomplished at the proper time following the connection of the yarn with the bobbin tube, for instance in that the infeed element is manually again moved away from the bobbin tube and the yarn is severed in front of the front end of the infeed element, for instance with the aid of a scissor or a knife or other suitable cutting device. Thereafter, it is then possible to remove the infeed element with the hose line from the stationary suction nozzle of the spinning location and the suction nozzle can be closed.

Of course, the invention is not in any way intended to be limited to the exemplary described embodiments. For instance, it is possible to carry out modifications, such as to provide a different construction of the infeed element. For example, the infeed element could be in the form of a lengthwise extending member devoid of any pistol-like handgrip. Also it would be possible, for instance, to provide as the entrainment means cut-outs directly at the edge of a bobbin tube or sleeve and not at the bobbin tube supports, in the event that the bobbin tube is constructed as a one-piece roll without any tube supports.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of connecting a yarn and forming a yarn reserve upon a bobbin tube of an empty bobbin during a bobbin change operation after removal of the full bobbin at a spinning location of a spinning machine, especially an open end-spinning machine, comprising the steps of:

during the bobbin change operation continuously further delivering yarn from the spinning location;

removing the full bobbin at a spinning location of the spinning machine and severing the yarn extending from the full bobbin;

delivering the yarn from the spinning location for movement through a guide channel of a manually engageable and movable infeed device towards a stationary suction opening;

forming a free yarn path of travel at the infeed element prior to travel of the yarn into the guide channel;

guiding the yarn only at the start and end portions of the free yarn path of travel while rendering the yarn freely accessible at locations therebetween at all sides;

donning a new empty bobbin tube onto a bobbin holder;

manually moving the infeed element, while entraining the therethrough passing yarn, to the new empty bobbin tube;

manually shifting the free yarn path of travel by means of the infeed element towards the new bobbin tube;

bringing the yarn at such location into engagement with an engaging region of entrainment means arranged at an edge of the new bobbin tube and revolving therewith;

engaging and entraining yarn located at the free yarn path of travel by means of the entrainment means;

then severing the yarn located in the guide channel of the infeed element; and manually removing the infeed element from the new bobbin tube.

2. An apparatus for connecting a yarn and for forming a yarn reserve upon a bobbin tube of an empty bobbin during the bobbin change operation after removal of the full bobbin at a spinning location of a spinning machine, comprising:

means for infeeding the yarn;

a manually engageable and movable infeed element including a guide channel through which the yarn moves in the direction of a stationary suction opening;

means defining the stationary suction opening;

said infeed element being movable into a position cooperating with the empty bobbin tube for winding the incoming yarn thereon;

said infeed element comprising a manually engageable elongated base body having said guide channel arranged internally thereof;

said guide channel having a rear mouth oriented in the direction of the stationary suction opening;

said rear mouth being located at the end of the base body facing away from the empty bobbin tube during handling of the infeed element;

said guide channel having a front mouth oriented in the direction of the empty bobbin tube and location at the region of a front end of the base body;

means defining a yarn-free running path provided in front of the front mouth of the guide channel at the front end of the base body along the path of travel of the incoming yarn;

said means defining said yarn-free running path including front and rear ends, viewed with respect to the direction of travel of the incoming yarn;

said yarn slidingly bearing at the front and rear ends of said yarn-free running path and being freely accessible at all sides without contacting the base body at locations disposed between said ends.

3. The apparatus as defined in claim 2, wherein:

said means defining said yarn-free running path comprises means connected with said base body at which bears the yarn at the front and rear ends of the yarn free-running path.

4. The apparatus as defined in claim 2, wherein:

said front and rear ends of the yarn-free running path comprise edge means arranged at said base body.

5. The apparatus as defined in claim 4, wherein:

said edge means are formed of one-piece with the base body; and recess means provided at the base body between said edge means.

6. The apparatus as defined in claim 2, further including:

means defining an infeed channel for the yarn provided at said base body;

said infeed channel being open at one side and being arranged in front of the yarn-free running path with respect to the direction of yarn travel.

7. The apparatus as defined in claim 6, wherein:

said infeed channel possesses a depth which decreases in the direction of travel of the yarn.

8. The apparatus as defined in claim 6, wherein:

said infeed channel is formed of one-piece with the base body.

9. The apparatus as defined in claim 8, wherein:

said infeed channel possesses a depth decreasing in the direction of yarn travel.

10. The apparatus as defined in claim 2, further including:

means defining a contact surface arranged at the front end of the base body adjacent the yarn-free running path;

said contact surface serving for the application of the infeed element at the outer circumference of the empty bobbin tube for transferring the yarn to entrainment means of the bobbin tube.

11. The apparatus as defined in claim 2, further including:

bobbin holder means for the bobbin tube;

a side of the front mouth of the guide channel being situated closest to the bobbin holder means;

means defining a guide surface arranged with regard to the direction of travel of the yarn behind the rear end of the yarn-free running path at said side of the front mouth of the guide channel closest to the bobbin holder means and in spaced relationship from the front mouth;

said guide surface being adapted to come into contact with the bobbin holder means and for ensuring the provision of a free space for the yarn travel.

12. The apparatus as defined in claim 2, further including:

cutter means provided in the infeed element;

said cutter means having a cutter disposed at one location of the guide channel for movement into said guide channel in a direction essentially transversely with respect to the lengthwise extent thereof.

13. The apparatus as defined in claim 2, further including:

flexible conduit means for operatively connecting the rear mouth of the guide channel at the infeed element with said suction opening.

14. The apparatus as defined in claim 2, further including:

handle means for handling the infeed element provided at the base body thereof.

15. The apparatus as defined in claim 2, further including:

cutter means provided in said infeed element;

said cutter means having a cutter at one location of the guide channel movable essentially transversely with respect to the lengthwise extent of said guide channel and into said guide channel;

an actuation device arranged at the infeed element and operatively coupled with the cutter of the cutter means; and upon gripping the infeed element with the hand of the operator said actuation device being operated.

16. The apparatus as defined in claim 6, wherein said base body is provided at its front end with substantially trough-shaped recess means serving as the yarn-free running path and extending from the top of the base body which faces away from the empty bobbin tube in the position of use of the infeed element;

a side wall for limiting said recess means at the side neighboring a next situated bobbin holder in the position of use;

said side wall having an outer side facing away from said recess means and extending essentially perpendicular to the end of the base body;

said front mouth of the guide channel opening into said outer side in spaced relationship behind the end of the base body;

a guide surface merging at the outer side of the side wall behind the front mouth and in spaced relationship therefrom and extending essentially perpendicular to the end of the base body;

the infeed channel extending from the top of the base body at an inclination from its front end towards its rear in the direction of the side of the base body facing away from the guide surface;

a contact surface constructed as a surface extending gradually towards the rear and towards the underside of the base body at the location of the end of the base body below the front mouth of the infeed channel and the lower end of the trough-shaped recess means.

17. The apparatus as defined in claim 16, wherein:

the length of the yarn-free running path is selected to be approximately twice as long as the axial spacing of the yarn reserve from the edge of the end of the bobbin tube and which yarn reserve is to be wound upon the end of the bobbin tube at the start of the winding-up operation.

18. The apparatus as defined in claim 17, wherein:

the spacing of the guide surface from the start of the yarn-free running path in the position of use of the infeed element, measured parallel to the lengthwise axis of the bobbin tube, is dimensioned such that the end of the yarn-free running path is located somewhat outside of the end of the bobbin tube.

19. The apparatus as defined in claim 18, wherein:

the guide channel extends initially at an inclination towards the rear from the front mouth at said outer side and then merges with channel means leading to the rear end of the base body.

20. The apparatus as defined in claim 19, further including:

means for guiding the cutter of the cutting device to be movable back and forth in the base body at the region of an inclined part of the guide channel in a direction essentially parallel to the primary lengthwise direction of the base body and the guide surface.

21. The apparatus as defined in claim 20, wherein:

said infeed element is provided with a substantially pistol-like handgrip protruding at an inclination from and mounted at said base body.

22. The apparatus as defined in claim 21, wherein:

an actuation element of an actuation device for the cutter is mounted at a position at the infeed element which is accessible by the gripping hand of the operator holding said handgrip.

23. The apparatus as defined in claim 22, further including:

yarn entrainment means comprising cut-outs arranged distributively circumferentially about the bobbin tube at the edge of the end of the bobbin tube onto which there is to be wound a yarn reserve at the start of the winding-up of the yarn;

said cut-outs extending at an inclination inwardly from the periphery of the end of the bobbin tube in a direction opposite to the direction of rotation of the bobbin tube.

24. The apparatus as defined in claim 23, wherein:

said bobbin tube onto which there is to be wound the yarn comprises a sleeve containing a sleeve jacket in the form of a hollow cylinder;

two sutstantially circular disc-like sleeve supports;

a respective one of each sleeve support being arranged at one respective end of the hollow cylinder;

a respective bobbin holder at which a respective one of said sleeve supports is rotatably mounted;

each sleeve support having an outer diameter corresponding to the outer diameter of the sleeve and in the assembled state covering the neighboring end of the hollow cylinder; and said cut-outs of the entrainment means being provided at the outer edge of at least one of the sleeve supports.

25. The apparatus as defined in claim 24, wherein:

said cut-outs extend inwardly from the outer edge of the sleeve support at an angle $\alpha$ amounting to between 30° and 45°, measured with respect to an ideal radius extending through the start of each cut-out at the outer periphery.

26. The apparatus as defined in claim 24, wherein:

said cut-outs extend substantially linearly along chord sections of the circular disc-shaped sleeve support.

* * * * *